US005149024A

United States Patent [19]

Kawashima et al.

[11] Patent Number: 5,149,024

[45] Date of Patent: Sep. 22, 1992

[54] CONVEYOR CARRIAGE CONTROL SYSTEM

[75] Inventors: Hiroshi Kawashima; Keiji Yamamoto, both of Iwata, Japan

[73] Assignee: Yamaha Hatsudoki Kabushiki Kaisha, Iwata, Japan

[21] Appl. No.: 548,266

[22] Filed: Jul. 5, 1990

[30] Foreign Application Priority Data

Aug. 9, 1989 [JP] Japan ..... 1-204820

[51] Int. Cl.[5] ..... B61L 3/18

[52] U.S. Cl. ..... 246/66; 246/187 B; 246/187 C

[58] Field of Search ..... 246/2 S, 28 R, 62, 64, 246/65, 66, 69, 122 R, 167 D, 186, 187 R, 187 A, 187 B, 187 C, 246, 249, 250; 104/298, 299, 301; 191/14, 15

[56] References Cited

U.S. PATENT DOCUMENTS

| | | | |
|---|---|---|---|
| 1,054,277 | 2/1913 | Carboni et al. | 246/66 |
| 1,617,402 | 2/1927 | Loughridge | 246/66 X |
| 1,857,760 | 5/1932 | Loughridge | 104/298 X |
| 1,877,626 | 9/1932 | Loughridge | 246/187 C |
| 3,506,823 | 4/1970 | Failor | 246/187 R X |
| 3,596,086 | 7/1971 | Etter et al. | 246/66 |
| 4,688,487 | 8/1987 | Dollens et al. | 104/298 |
| 4,919,057 | 4/1990 | Riley | 246/28 R X |
| 4,922,830 | 5/1990 | Fujita et al. | 246/187 B X |

FOREIGN PATENT DOCUMENTS

| | | | |
|---|---|---|---|
| 0354461 | 2/1990 | European Pat. Off. . | |
| 1588331 | 12/1977 | Fed. Rep. of Germany | 246/25 |

*Primary Examiner*—Frank E. Werner
*Assistant Examiner*—Scott L. Lowe
*Attorney, Agent, or Firm*—Bacon & Thomas

[57] ABSTRACT

A system for controlling the movement of carriages in a conveyor system is disclosed in which individually powered carriages are controlled so as to stop a carriage at a designated position on the conveyor rail. Electrical contact wires extend along the conveyor rail and are electrically connected to controller units on each of the carriages by electrical contacts sliding along the electrical contact wires. Certain ones of the electrical contact wires have electrical discontinuities which define boundaries of first and second zones. The electrical discontinuities form a normally open electrical circuit with the controller units of each of the carriages, thereby keeping such controller units in the inoperative or "off" position. In this position of the controller unit, the power unit of each of the individual carriages drives the carriage along the conveyor rail. When the electrical circuit of the electrical contact wires is completed in a first zone, such as by the presence of a stopped carriage or other obstruction, the controller unit of a carriage entering the adjacent second zone will be actuated by this completed electrical circuit and will stop the carriage before it encounters the stopped carriage or other obstruction.

24 Claims, 4 Drawing Sheets

CONVEYOR CARRIAGE CONTROL SYSTEM

BACKGROUND OF THE INVENTION

The present invention relates to a control system for controlling the movement of conveyor carriages along a conveyor rail.

Conveyor systems in which several travelling units or carriages travel along a conveyor rail have found widespread acceptance in virtually every form of manufacturing operations. Such systems have proven invaluable in transporting individual parts and sub-assemblies between storage areas and work stations. Conveyor systems with individually powered carriages moving along the conveyor have proven most satisfactory insofar as they allow each carriage to move separately thereby enabling stops of varying durations at each work station.

However, the use of such conveyors having individually powered carriages has also required some means to prevent the moving carriage from colliding with a carriage which has stopped. Sophisticated sensing systems have been provided to sense the presence of a stopped carriage, or other obstacle present in the path of a moving carriage. These systems typically require each carriage to have sensors positioned both in the front and the back to prevent the carriages from colliding.

While these systems have proven generally satisfactory, they often fail to prevent carriage collisions where the conveyor rail is curved and wherein a stopped or slowly moving carriage is located on one side of the curve and the more rapidly moving carriage is located on the other side of the curve. In this situation, the stopped or slowly moving carriage is usually outside of the range of the sensors of the faster moving carriage. Thus, the sensors on the faster moving carriage are unable to detect the presence of the stopped or slower moving carriage and collisions often result.

Also, the requirement to place such sophisticated sensors on each carriage increases the cost and complexity of the conveyor system. Such increase in complexity inherently reduces the reliability of such a conveyor system, especially when located in an industrial environment.

SUMMARY OF THE INVENTION

A system for controlling the movement of carriages in a conveyor system is disclosed in which the individually powered carriages are controlled so as to stop a carriage at a designated position on the conveyor rail. Electrical contact wires extend along the conveyor rail and are electrically connected to controller units on each of the carriages by electrical contacts sliding along the electrical contact wires. Certain ones of the electrical contact wires have electrical discontinuities which define boundaries of at least first and second zones. The electrical discontinuities form a normally open electrical circuit with the controller units of each of the carriages, thereby keeping such controller units in the inoperative or "off" position. In this position of the controller unit, the power unit of each of the individual carriages drives the carriage along the conveyor rail.

However, when the electrical circuit of the electrical contact wires is completed in a first zone, such as by the presence of a stopped carriage or other obstruction, the controller unit of a carriage entering the adjacent second zone will be actuated by this completed electrical circuit and will stop the carriage before it encounters the stopped carriage or other obstruction.

Since this system does not rely on known sensor systems, it will work reliably even if the conveyor rail is curved and the stopped carriage or other obstruction is located on the curve.

DETAILED DESCRIPTION OF THE PREFERRED EMBODIMENT

Figure 1:
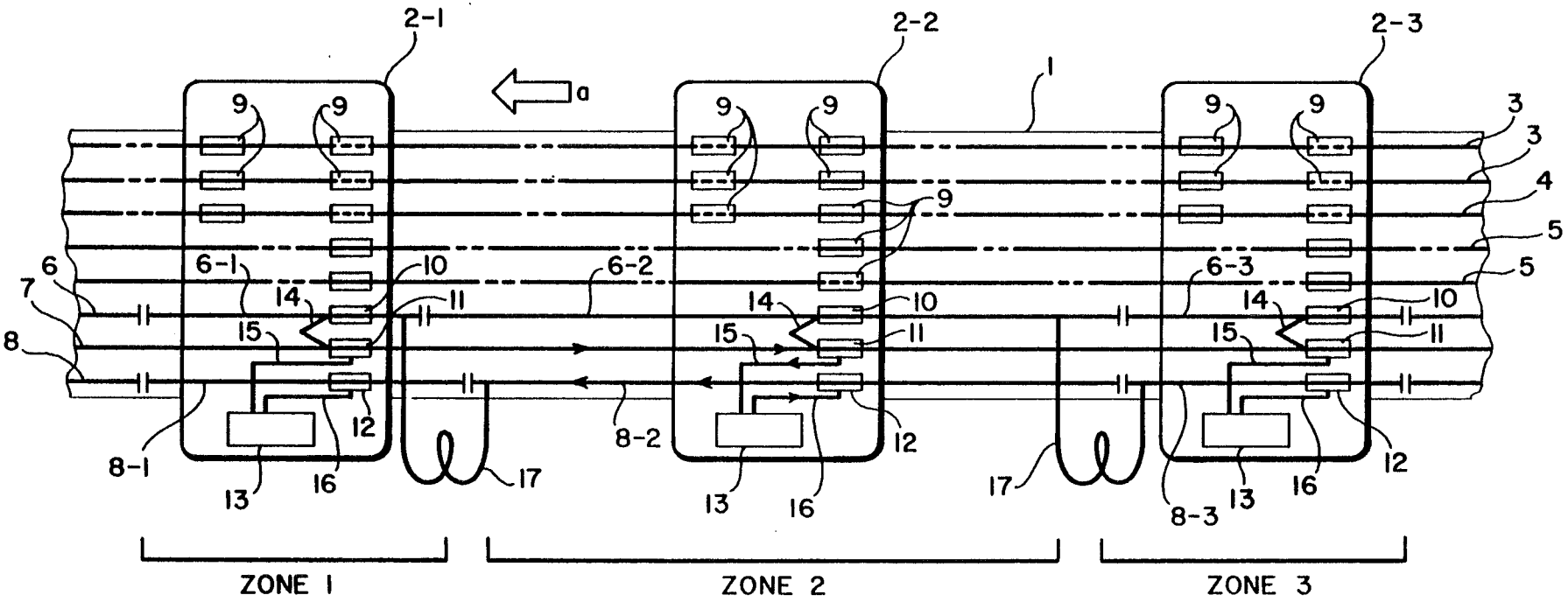
FIG. 1 is a partial, diagrammatic representation of the carriage control system according to the present invention.

The carriage control system according to the present invention establishes at least two zones along the conveyor rail such that the individually powered and moveable carriages will stop in one of the zones when a stopped carriage or other obstruction is present in the other zone. As best seen in FIG. 1, an endless conveyor rail, which may be part of a closed loop conveyor system as shown in European patent 0 354 461, has a plurality of carriages 2-1, 2—2 and 2-3 mounted thereon such that the carriages are individually moveable along the conveyor rail 1. The conveyor system may be a monorail-type conveyor wherein the carriages are either suspended from the rail or are supported on the rail. The individual carriages travel in the direction indicated by arrow a in FIG. 1.

The conveyor rail 1 has, in known fashion, electrical power supply lines 3, a ground carriage line 4 and carriage signal transmission lines 5. The lines 3 and 4 supply electrical power to the individual power units of the carriages (not shown), while signal transmission lines 5 send, in known fashion, various commands to the individual carriages.

In addition to the electrical lines 3, 4 and 5, additional electrical contact wires 6, 7 and 8 are located on the conveyor rail 1. As can be seen, first electrical contact wire 7 is continuous throughout the length of the conveyor rail 1, while second and third electrical contact wires 6 and 8 have electrical discontinuities at specific locations. These discontinuities, which may be achieved by either physical breaks in the electrical contact wires or by other insulating means, define the boundaries of zones 1, 2 and 3. As noted in FIG. 1, the electrical discontinuities in the second electrical contact wire 6 divide this wire into segment 6-1 in zone 1, segment 6-2 in zone 2 and segment 6-3 in zone 3. Similarly, electrical contact wire 8 is divided into segment 8-1 in zone 1, segment 8-2 in zone 2 and segment 8-3 in zone 3.

Each of the carriages 2-1, 2-2 and 2-3 have electrical contacts 9 that engage the electrical lines 3, 4 and 5 in known fashion in order to supply the requisite electrical signals to the machinery on each of the carriages. Each carriage also has electrical contacts 10, 11 and 12 located thereon so as to be in electrical contact with electrical contact wires 6, 7 and 8 respectively.

A control unit 13 is present on each of the carriages and is electrically connected to electrical contacts 11 and 12 by wires 15 and 16, respectively. Electrical contacts 10 and 11 on each carriage are connected by switch 14. Wire 17 electrically connects either the second or third electrical contact wire in zone 1 with the opposite electrical contact wire in zone 2. As illustrated in FIG. 1, the second electrical contact wire segment 6-1 in zone 1 is electrically connected to the third contact wire segment 8-2 in zone 2.

The controller unit 13 on each of the carriages is interconnected to the carriage power unit (as will be described in more detail hereinafter) and is normally held in the "off" position which enables the carriage to move along conveyor rail 1 in normal fashion. The electrical discontinuities in the second electrical contact wire 6 and the third electrical contact wire 8 normally form an open electrical circuit with the controller units 13, thereby keeping the controller units in their "off" positions. As illustrated with reference to the carriage 2-3 in FIG. 1, the electrical circuit includes the first electrical contact wire 7, the electrical contact 11, wire 15, controller unit 13, electrical wire 16, electrical contact 12 and electrical contact wire 8 (segment 8-3). Since wire 8 has electrical discontinuities, this circuit is normally open and the controller unit 13 is "off". This enables the carriage to run freely on conveyor rail 1.

However, when a carriage is stopped in zone 1, in the position of carriage 2-1 in FIG. 1, the normally opened electrical circuit is closed and the controller unit 13 of carriage 2-2 located in zone 2 is turned "on" to stop the carriage. As can be seen in FIG. 1, the closed electrical circuit is as follows: controller unit 13 (in carriage 2-2); wire 16; electrical contact 12; electrical contact wire segment 8-2; wire 17; electrical contact wire segment 6-1; electrical contact 10 (on carriage 2-1); switch 14; electrical contact 11 (on carriage 2-1); first electrical contact wire 7; electrical contact 11 (on carriage 2-2); and wire 15. This closed electrical circuit turns the controller unit 13 of carriage 2-2 "on" thereby stopping this carriage in zone 2 and preventing it from colliding with carriage 2-1 stopped in zone 1.

As can be seen, the carriage control system according to this invention does not require the use of any sophisticated sensors located on the carriages and is, thus, effective even if the carriages are located on opposite sides of a curved conveyor rail section. It also eliminates the need for the sophisticated control devices and wiring associated with the sensors and thereby lowers the cost of the conveyor system.

Figure 5:
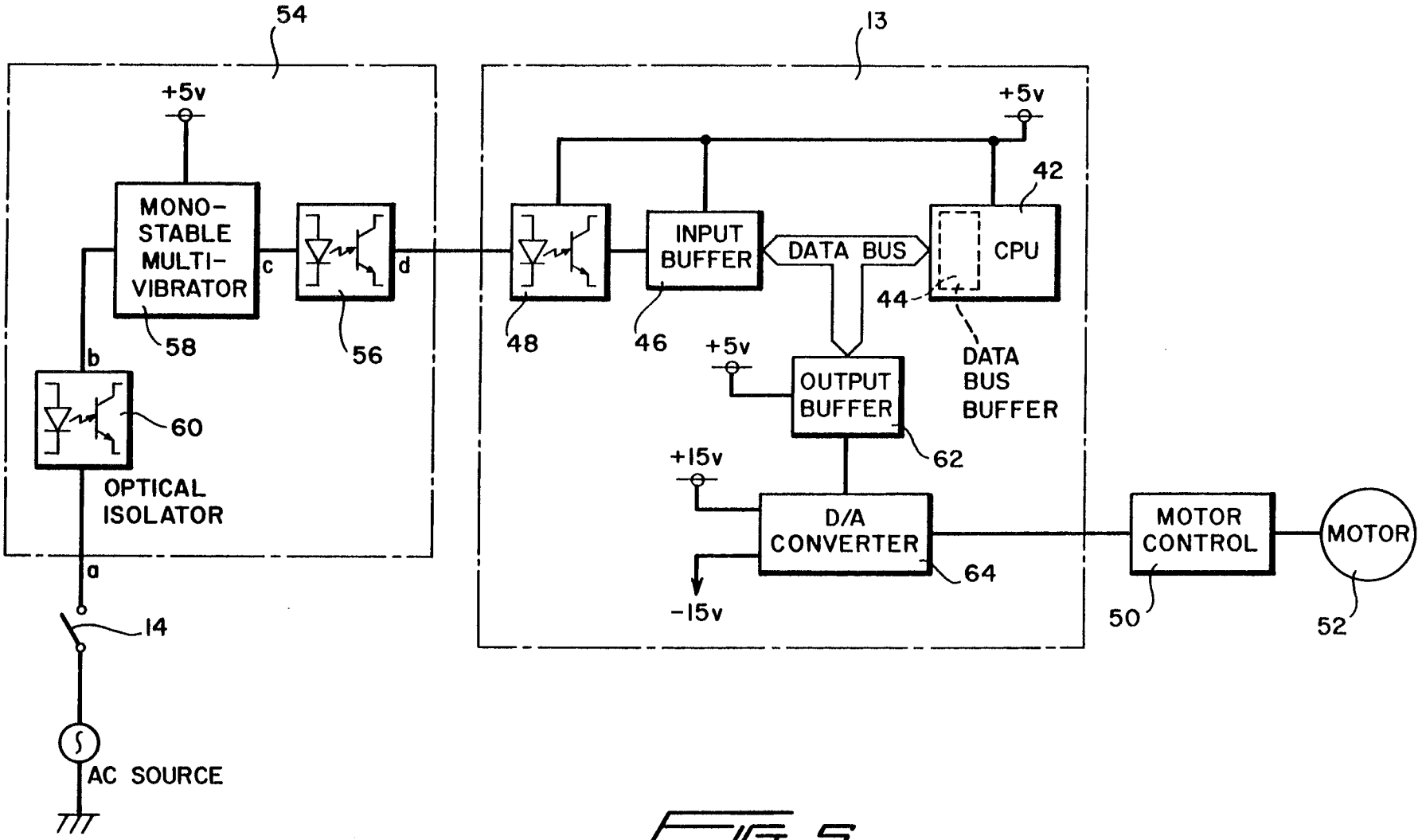
FIG. 5 is a schematic diagram of the controller unit and its connection to the carriage drive system.
Figure 6:
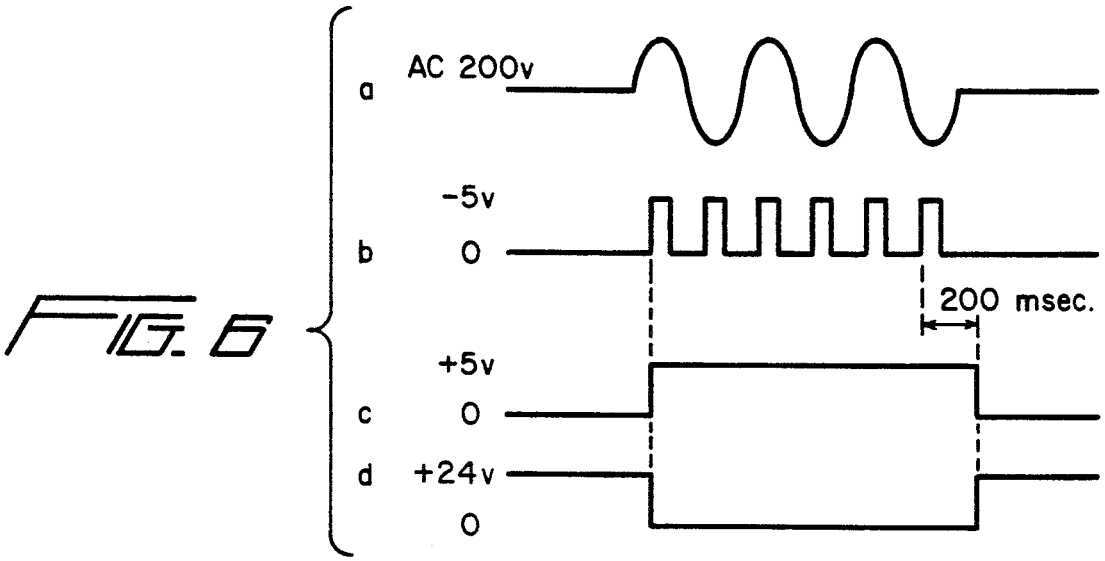
FIG. 6 is a timing chart illustrating the characteristics of the signals at points a, b, c and d of the noise filter illustrated in FIG. 5.

A schematic diagram for the controller unit 13 is presented in FIG. 5. As can be seen, the controller unit 13 comprises a central processing unit (CPU) 42 incorporating a data bus buffer 44. The CPU is connected to an input buffer 46 via a data bus. The input buffer 46 is, in turn, connected to an optical isolator 48 electrically connected to switch 14 through noise filter 54. Noise filter 54 comprises a second optical isolator 56, a monostable multivibrator 58 and a third optical isolator 60 connected between switch 14 and optical isolator 48 as illustrated in FIG. 5. Filter 54 converts the analog signal from an AC source into a digital signal to eliminate signal noise. The signals at points a, b, c and d in the noise filter 54 are shown in the noise filter timing chart illustrated in FIG. 6. The chart illustrates voltage vs. time for the points a, b, c and d. The output of CPU 42 is connected to an output buffer 62 via the data bus so as to transmit a control signal to the motor control 50, which controls motor 52, through digital/analog converter 64.

Usually, the optical isolator 48 provides a high level voltage (1) to the input buffer 46. However, when the electrical circuit with which the controller unit 13 is associated is closed, the output of the optical isolator 48 changes to a low level voltage (0).

The input buffer 46, as controlled by the CPU 42, inverts the signal from the optical isolator 48. Thus, when optical isolator 48 provides a high voltage (1) input signal, the buffer 46 provides a low voltage (0) output signal to the data bus buffer 44. Conversely, when the optical isolator 48 provides a low level voltage (0) signal to the input buffer 46, the buffer 46 will provide a high voltage (1) signal to the data bus buffer 44.

Figure 7:
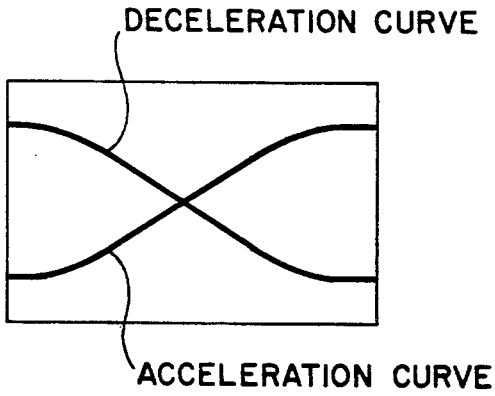
FIG. 7 is a graph illustrating the characteristics of the acceleration-deceleration data furnished to the motor controller.

CPU 42 samples the signal stored in the data bus buffer 44 every 20 msec. If the signal stored in the data bus buffer 44 is high (1), the CPU provides a signal to the motor control 50, as illustrated in FIG. 7, to decelerate the movement of the carriage. The deceleration may be achieved by reducing motor speed, disengaging a clutch between the motor and the carriage drive wheels and actuating a carriage brake.

When the signal in the data bus buffer 44 changes from high (1) to low (0), thereby indicating an open electrical circuit, the CPU actuates the motor driver to accelerate the carriage along the acceleration curve indicated in FIG. 7.

Figure 2:
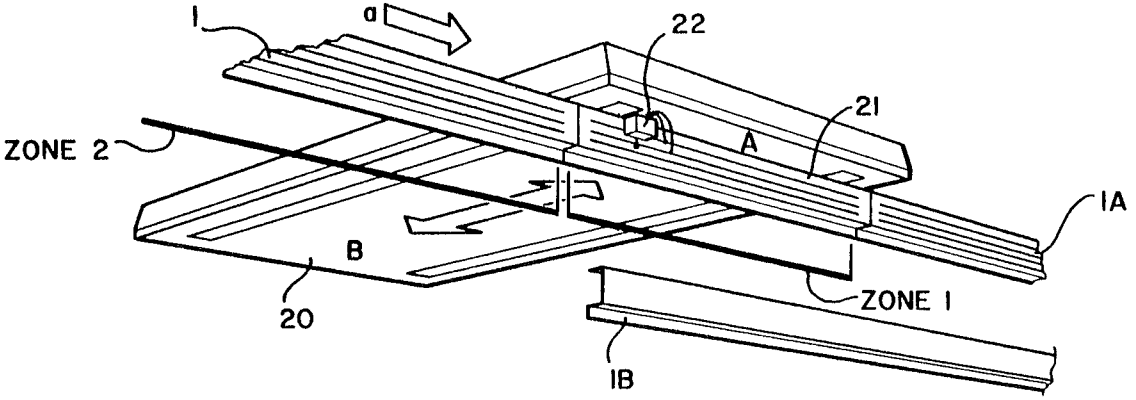
FIG. 2 is a partial, perspective view illustrating the system of the present invention utilized in conjunction with a rail switching system.

It is also possible to use the system according to the invention for purposes other than to avoid collisions between conveyor carriages. As shown in FIG. 2, the system can be used to stop the carriage in the second zone (zone 2) when a conveyor rail switching section, located in zone 1, is not in the proper position. In this instance, conveyor rail 1 includes a movable switching section 21 that is movable between a first position A in which it is aligned with conveyor rail portion 1A and second position B wherein it is in alignment with conveyor rail section 1B. The movable rail section 21 is moved between these positions A and B by known branching or switching device 20.

A limit switch 22 is electrically connected to the first and second electrical contact wires 6 and 7 such that, when the switch is closed, the electrical circuit between these elements is closed. When the switch 22 is opened, the electrical discontinuities in the second and third electrical contact wires 6 and 8 will present an open electrical circuit, thereby keeping the controller units 13 in their "off" positions. Again, this will enable the carriages to travel freely along conveyor rail 1.

The switch 22 is located such that it is contacted by the movable rail section 21 when in the position in alignment with rail section 1A such that the switch is maintained open and the carriages may travel along the conveyor rail 1, across movable section 21 and onto the conveyor section 1A. However, when the movable rail section 21 is moved to the second position in alignment with conveyor rail section 1B, the electrical switch 22 is closed, thereby forming a completed electrical circuit with the controller unit 13 of a carriage entering the zone 2 so as to stop the carriage in this zone before it reaches the gap in the conveyor rail 1 vacated by the conveyor rail section 21.

Figure 3:
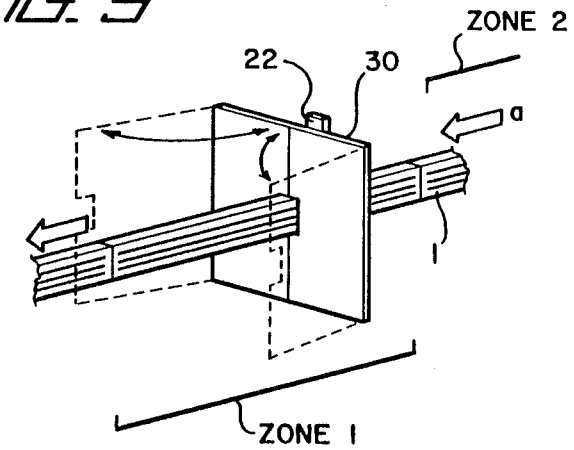
FIG. 3 is a partial, perspective view illustrating the carriage control system according to the invention used in conjunction with a conveyor door closure.

FIG. 3 illustrates another use of the carriage control system wherein the switch 22, connected to the conveyor rail electrical contact wires 6, and 7 as previously described in regard to the embodiment shown in FIG. 2, is actuated by the position of door 30. Door 30 may extend transversely across the conveyor rail 1 and may be used to prevent the transmission of noise between adjacent conveyor stations, to prevent the spread of fire, or to maintain temperature on one side of the door and not the other. In this situation, the door is located in zone 1 with zone 2 being immediately upstream on the conveyor rail 1.

Thus, when the door 30 is closed, as illustrated in solid lines in FIG. 3, the switch 22 closes the electrical circuit such that any carriage entering the adjacent zone 2 will have its control unit 13 turned "on" and will stop before encountering the door 30. When the door 30 is swung to its open position, as illustrated in dashed lines in FIG. 3, the switch 22 is opened thereby enabling the carriage to pass through zones 2 and 1.

Figure 4:
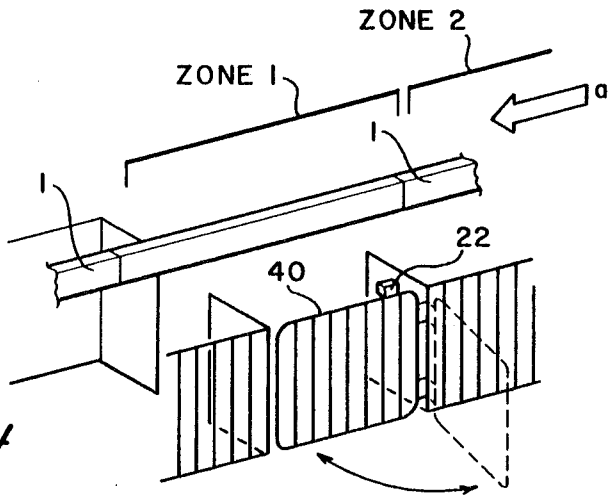
FIG. 4 is a partial, perspective view illustrating the carriage control system according to the present invention utilized with a gate control system.

A similar arrangement is shown in FIG. 4 wherein the carriage control system is utilized to control the movement of carriages over or through a worker passage area. As illustrated in this figure, a gate 40 normally closing the passage area to vehicular or pedestrian traffic is located in zone 1 as is switch 22. When the gate 40 is in its closed position, the switch 22 is opened to form an open electrical circuit with the first and second electrical contact wires 7 and 6, respectively. This enables the carriages to pass through the passage area on the conveyor rail 1.

When gate 40 is opened to allow the passage of traffic along the passageway, switch 22 is closed thereby forming a closed electrical circuit which will activate the controller unit 13 of a carriage entering the zone 2 and stop the carriage in this zone before it reaches the passageway.

The foregoing description is provided for illustrative purposes only and should not be construed as in any way limiting this invention, the scope of which is defined solely by the appended claims.

What is claimed is:

1. A system for controlling the movement of at least one carriage in a conveyor system having a conveyor rail and means on the at least one carriage to move the carriage along the conveyor rail comprising:

a) electrical wire means extending along the conveyor rail so as to define at least first and second zones, the electrical wire means normally forming an open electrical circuit;

b) means operatively associated with the electrical wire means in the first zone to selectively close the electrical circuit;

c) a drive motor located on the at least one carriage for moving the at least one carriage along the conveyor rail; and, d) controller means operatively associated with the at least one carriage and operatively associated with the drive motor and with the electrical wire means to control the drive motor and to stop the movement of the carriage in the second zone when the electrical circuit is closed, the controller means including:

i) analog to digital conversion means to convert an analog signal from the electrical wire means into a first digital signal;

ii) central processing unit means operatively associated with the analog to digital conversion means to receive the first digital signal from the analog to digital conversion means and to generate a second digital signal; and, iii) digital to analog signal conversion means operatively associated between the central processing unit and the drive motor to convert the second digital signal to an analog signal to control the operation of the drive motor.

2. The system according to claim 1 wherein the electrical wire means comprises:

a) a first electrical wire electrically continuous through the first and second zones;

b) second and third electrical wires having electrical discontinuities to define the boundaries of the first and second zones; and, c) electrical connector means electrically connecting the second electrical wire in one zone with the third electrical wire in the other zone.

3. The system according to claim 2 further comprising:

a) first electrical contact means located on each carriage in electrical contact with the first electrical wire and electrically connected to the controller means;

b) second and third electrical contact means located on each carriage in electrical contact with the second and third electrical wires, respectively;

c) means electrically connecting one of the second and third electrical contact means with the controller means and the other of the second and third electrical contact means with the first electrical contact means.

4. The system according to claim 3 wherein the electrical connector means electrically connects the second electrical wire in the first zone and the third electrical wire in the second zone.

5. The system according to claim 4 wherein the second electrical contact means is electrically connected to the first electrical contact means and the third electrical contact means is electrically connected to the controller means.

6. The system according to claim 1 wherein the means operatively associated with the electrical wire means in the first zone to close the electrical circuit comprises a second carriage.

7. The system according to claim 1 wherein the means operatively associated with the electrical wire means in the first zone to selectively close the electrical circuit comprises a switch means.

8. The system according to claim 7 further comprising means to locate the switch means remote from the conveyor rail.

9. The system according to claim 7 wherein the switch means comprises a limit switch.

10. The system according to claim 7, wherein the conveyor rail has a movable rail portion located in the first zone and further comprising means to locate the switch means such that the movement of the movable rail portion actuates the switch means.

11. The system according to claim 7 further comprising:

a) a movable door element located in the first zone; and, b) means to locate the switch means such that movement of the door element actuates the switch means.

12. The system according to claim 1 further comprising a first optical isolator operatively interposed between the analog to digital conversion means and the central processing unit.

13. The system according to claim 12 wherein the analog to digital conversion means comprises:

a) a second optical isolator operatively associated with the first optical isolator;

b) a mono-stable multivibrator operatively associated with the second optical isolator; and c) a third optical isolator operatively associated with the mono-stable multivibrator and the electrical wire means.

14. A system for controlling the movement of at least one carriage in a conveyor system having a conveyor rail and means on the at least one carriage to move the carriage along the conveyor rail comprising:

a) electrical wire means extending along the conveyor rail so as to define at least first and second zones, the electrical wire means normally forming an open electrical circuit;

b) means operatively associated with the electrical wire means in the first zone to selectively close the electrical circuit; and, c) controller means operatively associated with the at least one carriage and with the electrical wire means to stop the movement of the carriage in the second zone when the electrical circuit is closed, wherein the controller means comprises:

i) signal generating means operatively associated with the means to selectively close the electrical circuit such that a first signal is generated when the electrical circuit is open and a second signal is generated when the electrical circuit is closed, the signal generating means comprising optical isolator means operatively associated with the means to selectively close the electrical circuit and input buffer means operatively associated with the optical isolator; and, ii) central processing unit means operatively associated with the input buffer means and the drive motor such that the drive motor is actuated when the first signal is generated and de-actuated when the second signal is generated.

15. The system according to claim 14 wherein the electrical wire means comprises:

a) a first electrical wire electrically continuous through the first and second zones;

b) second and third electrical wires having electrical discontinuities to define the boundaries of the first and second zones; and, c) electrical connector means electrically connecting the second electrical wire in one zone with the third electrical wire in the other zone.

16. The system according to claim 15 further comprising:

a) first electrical contact means located on each carriage in electrical contact with the first electrical wire and electrically connected to the controller means;

b) second and third electrical contact means located on each carriage in electrical contact with the second and third electrical wires, respectively;

c) means electrically connecting one of the second and third electrical contact means with the controller means and the other of the second and third electrical contact means with the first electrical contact means.

17. The system according to claim 16 wherein the electrical connector means electrically connects the second electrical wire in the first zone and the third electrical wire in the second zone.

18. The system according to claim 17 wherein the second electrical contact means is electrically connected to the first electrical contact means and the third electrical contact means is electrically connected to the controller means.

19. The system according to claim 14 wherein the means operatively associated with the electrical wire means in the first zone to close the electrical circuit comprises a second carriage.

20. The system according to claim 14 wherein the means operatively associated with the electrical wire means in the first zone to selectively close the electrical circuit comprises a switch means.

21. The system according to claim 20 further comprising means to locate the switch means remove from the conveyor rail.

22. The system according to claim 20 wherein the switch means comprises a limit switch.

23. The system according to claim 20, wherein the conveyor rail has a movable rail portion located in the first zone and further comprising means to locate the switch means such that the movement of the movable rail portion actuates the switch means.

24. The system according to claim 20 further comprising:

a) a movable door element located in the first zone; and, b) means to locate the switch means such that movement of the door element actuates the switch means.

* * * * *